US005388876A

United States Patent [19]

Saincome

[11] Patent Number: 5,388,876

[45] Date of Patent: Feb. 14, 1995

[54] REFRIGERATOR SAFETY LATCHING DEVICE

[76] Inventor: Mark Saincome, 123 Pickford, Novi, Mich. 48377

[21] Appl. No.: 122,775

[22] Filed: Sep. 16, 1993

[51] Int. Cl.[6] ..... E05C 3/04

[52] U.S. Cl. ..... 292/54; 292/67; 292/218; 292/288; 292/DIG. 71; 292/DIG. 65; 70/DIG. 65

[58] Field of Search ..... 292/54, 67, 202, 218, 292/288, DIG. 65, DIG. 71, 106, 295–298, 207; 70/DIG. 65

[56] References Cited

U.S. PATENT DOCUMENTS

| | | | |
|---|---|---|---|
| 242,578 | 6/1881 | Ames, Jr. | 292/256.75 X |
| 361,922 | 4/1887 | Brabson | 292/239 |
| 1,033,785 | 7/1912 | Cowell | 29/205 |
| 1,774,850 | 9/1930 | Snook | 292/210 X |
| 2,079,167 | 5/1937 | Hafstad | 292/218 X |
| 2,683,049 | 7/1954 | van der Spek | 292/207 |
| 2,799,423 | 7/1957 | Kaye | 292/218 X |
| 2,830,547 | 4/1958 | Zieche | 109/63.5 |
| 2,833,579 | 5/1958 | Moody | 292/288 |
| 2,843,409 | 7/1958 | Johannesen | 292/165 |
| 3,069,217 | 12/1962 | Kors | 292/288 X |
| 3,572,794 | 3/1971 | Pastva | 292/218 |
| 4,506,527 | 3/1985 | Grill | 292/295 X |
| 4,648,637 | 3/1987 | Walter | 292/DIG. 71 X |
| 4,715,629 | 12/1987 | Robinson | 292/288 X |
| 4,833,737 | 5/1989 | Boucher et al. | 292/67 X |
| 4,834,434 | 5/1989 | Moore | 292/67 X |
| 4,915,430 | 4/1990 | Vitale | 292/DIG. 65 X |
| 4,921,287 | 5/1990 | Horvath et al. | 292/106 |
| 5,094,358 | 3/1992 | Serio, Sr. | 292/205 X |
| 5,114,193 | 5/1992 | Nass | 292/67 |
| 5,114,194 | 5/1992 | Toifl et al. | 292/106 |
| 5,152,564 | 10/1992 | Martineau | 292/288 |
| 5,209,533 | 5/1993 | Menard | 292/DIG. 71 X |
| 5,265,921 | 11/1993 | Nikitas et al. | 292/DIG. 71 X |

*Primary Examiner*—Peter M. Cuomo
*Assistant Examiner*—Suzanne L. Dino
*Attorney, Agent, or Firm*—Young, MacFarlane & Wood

[57] ABSTRACT

A safety latching device for refrigerators of the type having at least one vertically-hinged door extending the entire length of the refrigerator. The safety latching device includes an elongated support base having a latching bar rotatably attached thereto secured to the top of the refrigerator, and a coupling plate having a slot therein secured to the top of the refrigerator door in alignment with the latching bar. To prevent the refrigerator door from being opened by a young child, the latching bar is positioned in the coupling plate slot. To allow access to the refrigerator by an adult, the latching bar is rotatably moved from the slot. For refrigerators having more than one vertically-hinged door, the safety latching device utilizes a pair of latching bars with a pair of corresponding coupling plates.

18 Claims, 2 Drawing Sheets

FIG-3
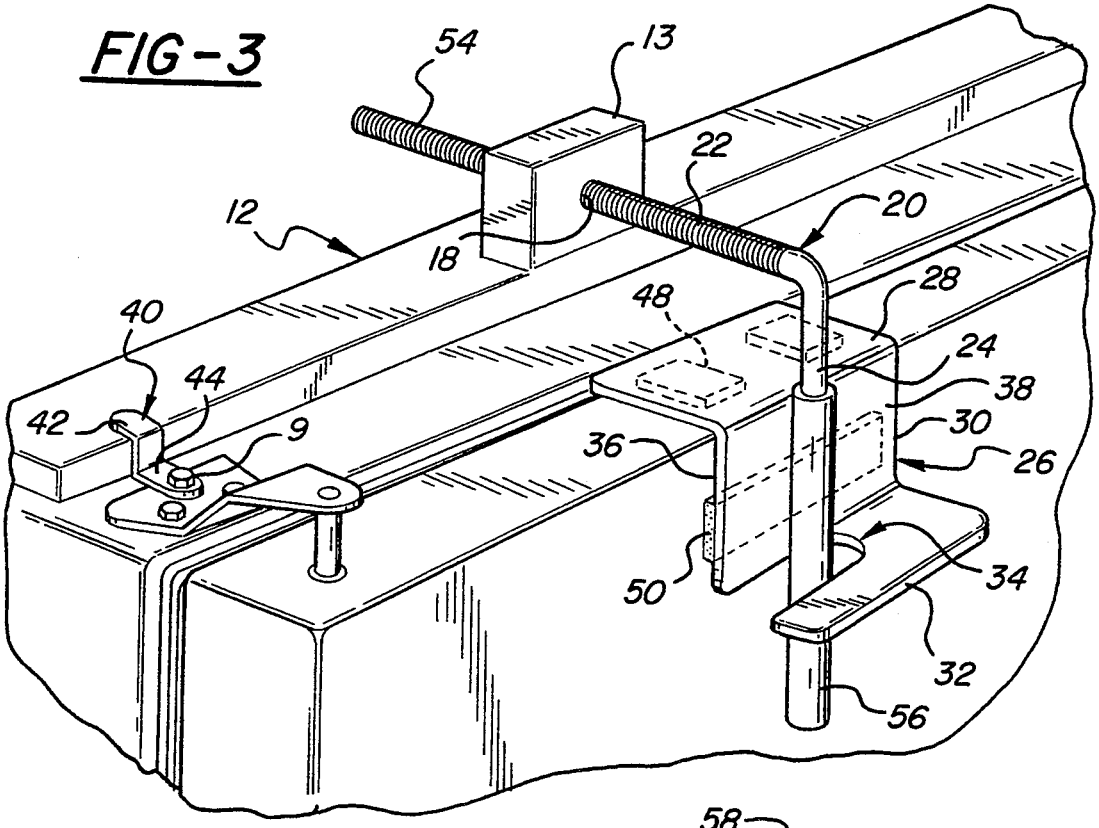
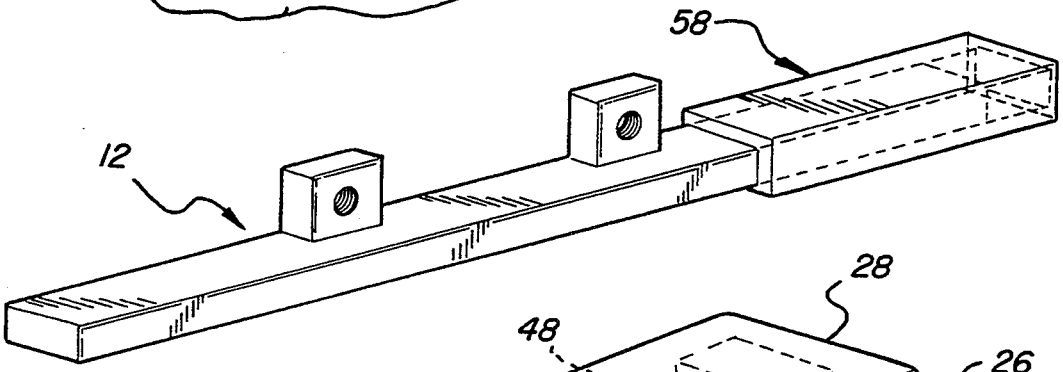
FIG-5
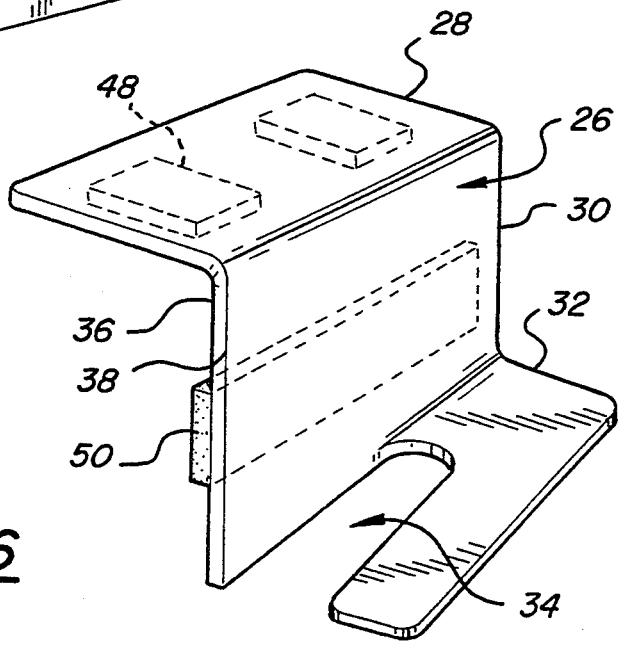
FIG-6

REFRIGERATOR SAFETY LATCHING DEVICE

FIELD OF THE INVENTION

This invention relates generally to the field of safety devices and more particularly to a refrigerator safety latching device which prevents access by toddlers and young children to refrigerators having double or single vertical doors which extend the entire length of the refrigerator.

DESCRIPTION OF THE RELATED PRIOR ART

Refrigerators can be potentially hazardous to toddlers and young children. For example, breakable items such as glass containers, raw food, alchohol, or certain medicines that require refrigeration pose a danger to children. In addition, perishable goods may be ruined if the refrigerator door is left open for extended periods.

Accordingly, there is a need in the art for a device which safely and effectively prevents young children from opening refrigerator doors yet does not substantially hinder adult access to the refrigerator or permanently alter or damage the refrigerator. Prior art devices employ self-sticking tape or suction-cups to attach the closure device to the appliance. These prior art devices are undesirable in that they are limited in strength, dependability and durability. Furthermore, these devices may pose a danger to the child if they become detached from the appliance because they are small enough to be swallowed by the child. It is also known in the art to attach closure devices to appliances using screws. However, such devices require that additional screw holes be added to the appliance, thus violating the structural integrity of the appliance and permanently altering the appearance of the appliance when the closure device is removed.

SUMMARY OF THE INVENTION

Disclosed and claimed herein is a refrigerator safety latching device for use in conjunction with refrigerators of the type having at least one vertically-hinged door which extends the entire length of the refrigerator and is hingedly-mounted to a refrigerator cabinet. The safety latching device is easily and securely installed and may be adapted to fit on any size refrigerator having a vertical door. When the safety latching device is in a first closed position, the refrigerator door is prevented from being opened by young children; however, the safety latching device may be easily moved to a second open position by an adult, thus allowing the refrigerator door to be opened. When the safety latching device is no longer needed, it may be easily removed without having altered the structural integrity of the refrigerator.

The safety latching device of the present invention comprises an elongated support base, a latching bar, and a coupling plate. The support base has a first end, a second end, and an aperture transversely therethrough and is secured to the top outer surface of the refrigerator cabinet proximate the refrigerator door. In an alternative embodiment, the support base may further include an extension sleeve slidably positioned over either the first end or second end of the support base to adjust the length of the support base to accommodate refrigerators of different sizes.

The latching bar of the safety latching device has a first portion configured to be snugly and rotatably retained in the aperture through the support base such that the first portion of the latching bar is in a plane parallel to the top surface of the refrigerator cabinet. The latching bar is substantially L-shaped and further includes a second portion which is substantially perpendicular to the first portion. The second portion may further include a cover to facilitate handling of the latching bar. In a preferred embodiment, the interior perimeter of the aperture through the support base and the outer perimeter of the first portion of the latching bar are both threaded for the dual purpose of securely retaining the bar within the aperture and adjusting the position of the second portion of the bar in relation to the refrigerator door.

The coupling plate of the safety latching device is secured to a top edge of the refrigerator door at a location thereon that is in alignment with the aperture in the support base. The coupling plate further includes a first portion dimensioned to partially cover the top edge of the refrigerator door, a second portion substantially perpendicular to the first portion which abuts the front of the refrigerator door, and a latching portion substantially perpendicular to the second portion. The latching portion extends outwardly from the refrigerator door and includes a slot extending partially therethrough. A magnet affixed to the inner refrigerator-facing surface of the coupling plate may be used to secure the coupling plate to the refrigerator. The inner surface of the coupling plate may also have a foam pad affixed thereto to protect the refrigerator surface.

A pair of fastening means may be employed to secure the ends of the support base of the safety latching device to the top of the refrigerator cabinet. In a preferred embodiment, the fastening means are attached to the hinge screw on the top outer surface of the refrigerator cabinet. Alternatively, the support base may either be a magnet or have magnets attached thereto.

Thus, when the safety latching device is secured to the-top of a refrigerator cabinet and the second portion of the latching bar is positioned in the slot in the coupling plate, the refrigerator door is prevented from being opened. Conversely, when the second portion of the latching bar is rotatably moved from the slot in the coupling plate, the refrigerator door may be opened. For refrigerators with two vertically-hinged doors which extend the entire length of the refrigerator, an alternative embodiment of the present invention may be provided which includes a support base with two apertures therethrough, two latching bars and two coupling plates.

BRIEF DESCRIPTION OF THE DRAWINGS

Other objects and advantages of the invention will become apparent upon reading the following detailed description and upon reference to the drawings, in which:

FIG. 3 is a perspective side view of a portion of the safety latching device;

FIG. 5 is a perspective view of an another embodiment of a support base of a safety latching device constructed according to the teachings of the present invention; and FIG. 6 is perspective view of a coupling plate of a safety latching device constructed according to the teachings of the present invention.

DETAILED DESCRIPTION OF THE INVENTION

Figure 1:
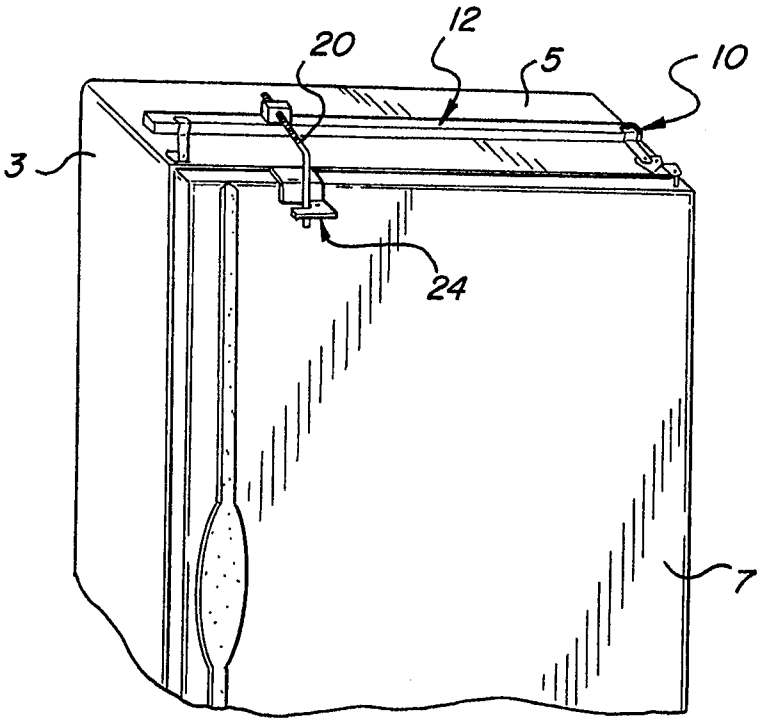
FIG. 1 is a perspective view of a safety latching device constructed according to the teachings of the present invention showing the safety latching device in use on a refrigerator.

Throughout the following detailed description, like reference numerals are used to refer to the same element of the invention shown in multiple figures thereof. Referring now to the drawings and, in particular, to FIGS. 1, 2 and 3, there is shown a safety latching device assembly 10 according to the present invention. The safety latching device 10 includes an elongated support base 12 including an aperture 18 therethrough, a latching bar 20, and a coupling plate 26. The support base 12 is secured to the top outer surface 5 of a refrigerator cabinet proximate the refrigerator door 7 and has a latching bar 20 rotatably retained in an aperture 18 through the support base 12. The coupling plate 26 is secured to the top of the refrigerator door 7 at a location thereon that is in alignment with the aperture 18 in the support base 12. When the latching bar 20 is positioned in the coupling plate 26, the refrigerator door is prevented from being opened. To open the refrigerator door, the latching bar 20 must be removed from the coupling plate 26.

Figure 2:
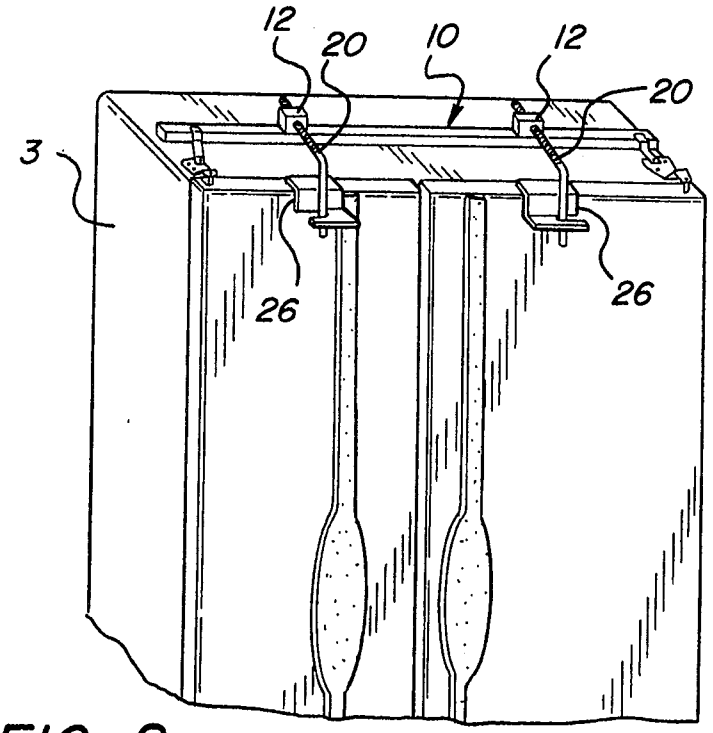
FIG. 2 is a perspective view of another embodiment of a safety latching device according to the present invention.

In the embodiment shown in FIG. 1, the safety latching device 10 is shown in use on a refrigerator having a single vertically-hinged door. In the embodiment shown in FIG. 2, the safety latching device 10 is shown in use on a refrigerator having two vertically-hinged doors. Thus, in the embodiment shown in FIG. 2, the support base 12 has a pair of apertures 18 therethrough, a pair of latching bars 20, and a pair of coupling plates 26.

Figure 4:
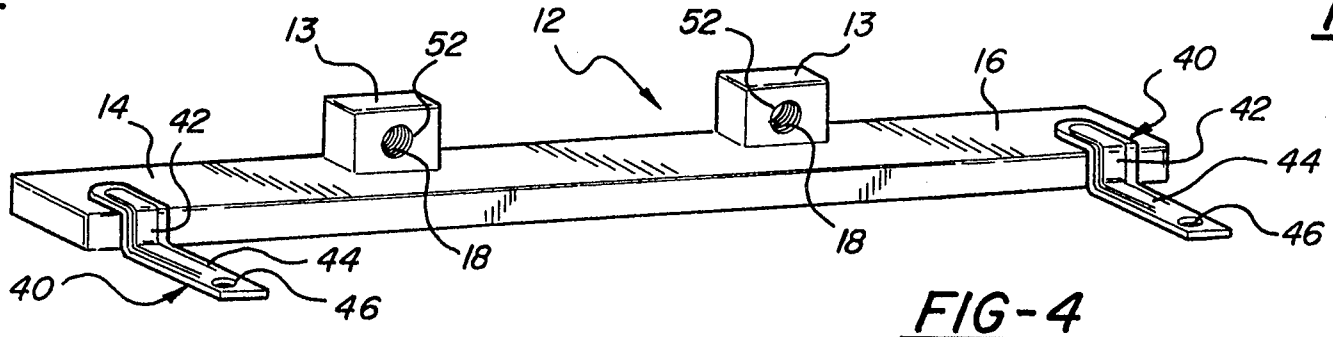
FIG. 4 is a perspective view of a support base of a safety latching device constructed according to the teachings of the present invention.

As best shown in FIGS. 4 and 5, the support base 12 includes a first end 14, a second end 16, and an aperture 18 transversely therethrough. The support base 12 may be substantially flat with a protruding portion 13 containing the aperture 18, as shown in the figures. Alternatively, the entire length of the support base 12 may be of a height sufficient to contain the aperture 18. In another embodiment, an extension sleeve 58 may be provided which is slidably affixed to either the first end 14 or the second end 16 of the support base 12. The extension sleeve 58 allows the length of the support base 12 to be increased to accommodate a variety of refrigerator cabinet sizes.

A pair of fastening means 40 may be used to secure the support base 12 to the refrigerator by positioning one of said pair of fastening means 40 proximate the first end 14 of the support base 12 and the other of said pair of fastening means 40 proximate the second end 16 of the support base 12. In the preferred embodiment, each of the fastening means 40 has a first portion 42 which abuts against the support base 12, a second portion 44 substantially perpendicular to the first portion 42, and an aperture 46 through the second portion 44. The aperture 46 is coupled in operative relation to a refrigerator hinge screw 9 by removing the hinge screw 9, inserting the hinge screw 9 through the aperture 46, and reattaching the hinge screw 9 to the top outer surface 5 of the refrigerator. In this manner, the safety latching device 10 may be secured to the refrigerator without damaging it. Alternatively, the support base 12 may itself be magnetic or have magnets affixed thereto.

The latching bar 20, best shown in FIG. 4, is substantially L-shaped and has a first portion 22 and a second portion 24. The first portion 22 is configured to be snugly and rotatably retained in the aperture 18 through the support base 12 such that the first portion 22 is in a plane parallel to the top surface of the refrigerator cabinet. The second portion 24 is substantially perpendicular to the first portion 22 and, when the safety latching device 10 is in its closed position, the second portion 24 of the latching bar 20 extends in front of and in a plane parallel to the refrigerator door. Optionally, the second portion 24 of the latching bar 20 may include a cover 56 to facilitate handling of the latching bar 20. In a preferred embodiment, the interior perimeter 52 of the aperture 18 through the support base 12 and the outer perimeter 54 of the first portion 22 of the latching bar 20 are both threaded for the dual purpose of securely retaining the latching bar 20 within the aperture 18 and adjusting the position of the second portion 24 of the latching bar 20 in relation to the refrigerator door.

As best shown in FIGS. 3 and 6, the coupling plate 26 has an inner surface 36 and an outer surface 38 and includes a first portion 28, a second portion 30, a latching portion 32 and a slot 34. The first portion 28 is dimensioned to partially cover the top of the refrigerator door. The second portion 30 is substantially perpendicular to the first portion 28 and abuts the front of the refrigerator door. The latching portion 32 is substantially perpendicular to the second portion 30 and extends outwardly from the refrigerator door from the end of the second portion 30 which is opposite the first portion 28. The latching portion 32 includes a slot 34 which extends partially therethrough. The coupling plate 26 is positioned on the refrigerator door in alignment with the aperture 18 in the support base 12 such that the second portion 24 of the latching bar 20 may be rotatably moved in and out of the slot 34 from a first closed position to a second open position. The inner surface 36 of the first portion 28 of the coupling plate 26 has a magnet 48 affixed thereto to secure the coupling plate 26 to the refrigerator. Optionally, the inner surface 36 of the second portion 30 of the coupling plate 26 may include a foam pad 50. The foam pad 50 both protects the refrigerator surface from scratching and provides a springy cushion effect to further protect the door when a young child attempts to open the door when the safety latching device 10 is in its closed position.

The support base 12, latching bar 20, and coupling plate 26 of the safety latching device 10 may be constructed out of durable plastic, wood or metal, or any other suitable material known in the art.

Thus it is apparent that there has been provided, in accordance with the invention, a safety latching device 10. While the invention has been described in conjunction with specific embodiments thereof, it is evident that many alternatives, modifications, and variations will be apparent to those skilled in the art in light of the foregoing description. Accordingly, the present invention is intended to embrace all such alternatives, modifications, and variations as falling within the spirit and broad scope of the claims.

I therefore claim:

1. A safety latching device for refrigerators of the type having at least one vertically-hinged door extending the entire length of the refrigerator and hingedly-mounted to a refrigerator cabinet, said safety latching device comprising:

an elongated support base having a first end and a second end, said support base secured to a top outer surface of said refrigerator cabinet proximate the refrigerator door, said support base further including an aperture transversely therethrough;

a latching bar having a first bar portion configured to be snugly and rotatably retained in said aperture through said support base such that said first bar portion is in a plane parallel to the top surface of the refrigerator cabinet, said latching bar further including a second bar portion substantially perpendicular to said first bar portion;

a coupling plate secured to a top edge of the refrigerator door at a location thereon that is in alignment with said aperture in said support base, said coupling plate further including a first plate portion dimensioned to partially cover the top edge of the refrigerator door, a second plate portion substantially perpendicular to said first plate portion, said second plate portion abutting the front of the refrigerator door, said coupling plate further having a latching portion substantially perpendicular to said second plate portion, said latching portion extending outwardly from said refrigerator door and including a slot extending partially therethrough, whereby when said second bar portion of said latching bar is positioned in said slot in a first closed position the refrigerator door is prevented from being opened and when said second bar portion of said latching bar is rotatably moved from said slot to a second open position, the refrigerator door may be opened.

2. The safety latching device of claim 1 further comprising a pair of fastening means, one of said fastening means proximate said first end of said support base and the other of said fastening means proximate said second end of said support base, whereby said fastening means secure said support base to the top outer surface of said refrigerator cabinet.

3. The safety latching device of claim 2 wherein each of said pair of fastening means is attached to a refrigerator hinge screw on the top outer surface of said refrigerator cabinet.

4. The safety latching device of claim 3 wherein each of said pair of fastening means has a first portion abutting said support base and a second portion substantially perpendicular to said first portion, said second portion having an aperture therethrough, whereby said aperture is coupled in operative relation to said refrigerator hinge screw such that said support base is secured to the top outer surface of said refrigerator cabinet.

5. The safety latching device of claim 1 wherein said coupling plate has an inner surface and an outer surface and wherein said inner surface of said first plate portion of said coupling plate further comprises a magnet affixed thereto.

6. The safety latching device of claim 1 wherein said coupling plate has an inner surface and an outer surface and wherein said inner surface of said second plate portion of said coupling plate further comprises a foam pad affixed thereto.

7. The safety latching device of claim 1 wherein said aperture has a threaded interior perimeter and said first bar portion of said latching bar has a threaded outer perimeter such that the threaded outer perimeter of the latching bar is configured to be correspondingly and securely engaged within said threaded interior of said aperture.

8. The safety latching device of claim 1 wherein said second bar portion of said latching bar further comprises a cover.

9. The safety latching device of claim 1 wherein said support base further comprises an extension sleeve slidably positioned proximate an end of said support base.

10. A safety latching device for refrigerators of the type having two vertically-hinged doors extending the entire length of the refrigerator and hingedly-mounted to a refrigerator cabinet, said safety latching device comprising:

an elongated support base having a first end and a second end, said support base secured to a top outer surface of said refrigerator cabinet proximate the refrigerator doors, aid support base further including a pair of apertures transversely through said support base, wherein one of said pair of apertures is proximate said first end of said support base and the other of said pair of apertures is proximate said second end of said support base;

a pair of latching bars, each of said latching bars having a first bar portion configured to be snugly and rotatably retained in one of said pair of apertures through said support base such that said first bar portion is in a plane parallel to the top surface of the refrigerator cabinet, each of said latching bars further including a second bar portion substantially perpendicular to said first portion;

a pair of coupling plates, one of each of said pair of coupling plates secured to a top edge of each refrigerator door at adjacent locations thereon such that said pair of coupling plates are in alignment with said pair of apertures in said support base, each of said pair of coupling plates further including a first plate portion dimensioned to partially cover the top of the refrigerator door, a second plate portion substantially perpendicular to said first plate portion, said second plate portion abutting the front of the refrigerator door, each of said pair of coupling plates further having a latching portion substantially perpendicular to said second plate portion, said latching portion extending outwardly from said refrigerator door and including a slot extending partially therethrough, whereby said second bar portion of each of said pair of latching bars is positioned in said corresponding slot in a first closed position the corresponding refrigerator door is prevented from being opened and when said second bar portion is rotatably moved from said slot to a second open position, the corresponding refrigerator door may be opened.

11. The safety latching device of claim 10 further comprising a pair of fastening means, one of said fastening means proximate said first end of said support base and the other of said fastening means proximate said second end of said support base, whereby said fastening means secure said support base to the top outer surface of said refrigerator cabinet.

12. The safety latching device of claim 11 wherein each of said pair of fastening means is attached to a refrigerator hinge screw on the top outer surface of said refrigerator cabinet.

13. The safety latching device of claim 12 wherein each of said pair of fastening means has a first portion abutting said support base and a second portion substantially perpendicular to said first portion, said second portion having an aperture therethrough, whereby said aperture is coupled in operative relation to said refrigerator hinge screw such that said support base is secured to the top outer surface of said refrigerator cabinet.

14. The safety latching device of claim 10 wherein each of said pair of coupling plates has an inner surface and an outer surface and wherein said inner surface of said first plate portion of each of said pair of coupling plates further comprises a magnet affixed thereto.

15. The safety latching device of claim 10 wherein each of said pair of coupling plates has an inner surface and an outer surface and wherein said inner surface of said second plate portion of each of said pair of coupling plates further comprises a foam pad affixed thereto.

16. The safety latching device of claim 10 wherein each of said pair of apertures has a threaded interior perimeter and said first bar portion of each of said pair of latching bars has a threaded outer perimeter such that the threaded outer perimeter of each latching bar is configured to be correspondingly and securely engaged within said threaded interior of said corresponding aperture.

17. The safety latching device of claim 10 wherein said second bar portion of each of said pair of latching bars further comprises a cover.

18. The safety latching device of claim 10 wherein said support base further comprises an extension sleeve slidably positioned proximate an end of said support base.

* * * * *